United States Patent [19]

Tate

[11] 4,056,481

[45] Nov. 1, 1977

[54] DETERGENT COMPOSITION

[75] Inventor: John Robert Tate, Whitley Bay, England

[73] Assignee: The Procter & Gamble Company, Cincinnati, Ohio

[21] Appl. No.: 539,756

[22] Filed: Jan. 9, 1975

[30] Foreign Application Priority Data

Jan. 11, 1974 United Kingdom ..... 1370/74

[51] Int. Cl.[2] ..... B02D 19/04; C11D 3/16; C11D 3/18

[52] U.S. Cl. ..... 252/140; 252/89 R; 252/321; 252/358

[58] Field of Search ..... 252/89, 321, 358, 116, 252/128, 130, 140, 155; 220/58

[56] References Cited

U.S. PATENT DOCUMENTS

| | | | |
|---|---|---|---|
| 1,875,530 | 9/1932 | Vaupotic | 252/112 |
| 2,390,212 | 12/1945 | Fritz | 252/358 |
| 2,545,677 | 3/1951 | Sperry | 252/358 X |
| 2,545,677 | 3/1951 | Sperry | 252/358 |
| 2,563,857 | 8/1951 | McGinn | 252/358 |
| 2,714,093 | 7/1955 | Blumenthal | 252/113 |
| 3,031,408 | 4/1962 | Perlman et al. | 252/154 |
| 3,129,187 | 4/1964 | Meehan | 252/155 |
| 3,224,976 | 12/1965 | Farrar et al. | 252/119 |
| 3,242,092 | 3/1966 | Bechtold | 252/140 X |
| 3,684,723 | 8/1972 | Best et al. | 252/358 |
| 3,706,675 | 12/1972 | Barth et al. | 252/321 |
| 3,869,412 | 3/1975 | Waag | 252/89 |
| 3,976,588 | 8/1976 | McLaughlin | 252/130 X |

FOREIGN PATENT DOCUMENTS

| | | | |
|---|---|---|---|
| 839,776 | 6/1960 | United Kingdom | 252/89 |

OTHER PUBLICATIONS

Chalmers, "Domestic and Industrial Chemical Specialties," The MacMillan Company, New York, 1966, pp. 141–154.

Kirk-Othmer, "Encyclopedia of Chemical Technology," 2nd Ed., John Wiley & Sons, vol. 15, 1968, pp. 92, 99–104.

Warth, "The Chemistry and Technology of Waxes," Reinhold Publishing Corp., New York, 1947, pp. 245, 247, 248.

Warth, "The Chemistry and Technology of Waxes," 2nd Ed., 1956, pp. 80, 81, 90, 380, 386–389, 391–393, 417–425, 428–431, 878.

Schwartz et al., "Surface Active Agents and Detergents," vol. II, Interscience Publishers Inc., New York, 1958, pp. 288–290, 307–308, 727.

Bennett, "Industrial Waxes," Chemical Publishing Co., New York, 1963, pp. 90, 96, 97, 107.

*Primary Examiner*—Harris A. Pitlick

[57] ABSTRACT

The invention relates to granular built laundry detergent compositions which have controlled sudsing properties in the rinse. The controlled sudsing is accomplished by the inclusion of microcrystalline waxes in the detergent composition.

11 Claims, No Drawings

DETERGENT COMPOSITION

BACKGROUND OF THE INVENTION

In general, detergent compositions intended for washing clothes are expected to provide copious suds during the washing cycle, although in recent years there has been a growing interest in avoiding excessive sudsing even at this stage. It is also important that the rinse water should not carry appreciable amounts of suds, especially in the second or later rinses, since such suds interfere with proper drainage of the rinse water from the wash tub or machine and may give an erroneous impression that rinsing has been inadequate. Soap products have generally been good in this respect, with the exception that in very soft water water hardness in the rinse effectively kills any suds. Anionic synthetic detergent products tend to provide very copious suds, sometimes excessive, in the wash and produce excessive suds in the rinse. In these products this latter fault can be countered by using known additives in the compositions, such as long chain soaps or fatty acids, silicone compounds and so forth. Usually these additives depress the suds in the washing step, but often this is an advantage or at least acceptable. Up to the present, most anionic detergent compositions have included considerable proportions of phosphate detergency builders.

Detergent compositions based upon nonionic detergents, or zwitterionic detergents alone and particularly mixtures thereof, or with anionic detergents can achieve improved cleaning compared with anionic detergents alone, especially when little or no phosphate builder is present. These compositions generally can provide adequate suds in the wash, but they tend to cause a severe problem of stable suds in the rinse. The usual suds depressants, suitable for use with anionic detergents, have proved unsuitable for correcting this fault. They fail for various reasons, for instance, they may be effective in the rinse at levels at which they also unduly depress the suds in the wash or at which they impair the cleaning performance or other properties of the product.

It is thus an object of the present invention to provide a detergent composition having depressed sudsing in the rinse.

It is a further object of this invention to provide suds control in the rinse without undue suds depression in the wash.

It has been found that it is possible to reduce the suds in the rinse arising from the use of nonionic, zwitterionic, or anionic synthetic detergents without unduly reducing the sudsing during the washing step. This is particularly valuable for detergent compositions based on nonionic or nonionic and zwitterionic mixed surfactants. Furthermore, the compositions of the invention can be selected so that a degree of suds suppression in the wash can be achieved in cases where such is desired.

Temperatures are in Centigrade and percentages and ratios are by weight unless otherwise indicated.

SUMMARY OF THE INVENTION

According to the invention there is provided a granular built detergent composition which comprises:

a. from about 2% to about 40% by weight of an organic synthetic detergent selected from the group consisting of nonionic, zwitterionic, and anionic detergents and mixtures thereof;

b. from about 0.02% to about 5% by weight of a substantially water-insoluble microcrystalline wax having a melting point in the range from 35° C to 115° C and saponification value less than 100 or mixtures thereof; and c. from about 10% to about 90% by weight of a detergency building salt or mixtures thereof; said wax in intimate admixture with the said organic detergent.

DESCRIPTION OF THE INVENTION

The way in which these waxes act is not fully understood, but while not wishing to be bound by any theory, the following explanation appears to fit the observed facts. It appears that the wax does not appreciably affect the sudsing of the compositions provided that it is substantially all solubilized by the detergents. Suitable waxes appear to be those which are water-insoluble but can be solubilized by the detergent employed and which remain solubilized at the concentration and temperature of the wash liquor. Intimate mixing of the wax with the detergent in preparing the composition appears to promote such solubilization.

Some interaction of the wax and/or the surfactant with the fabric appears to take place in the washing and rinsing processes, because the reduction in suds in rinses is greater when fabrics are present than when a corresponding dilution of the wash liquor is carried out in the absence of a fabric load. If the types and proportions of wax, surfactant, and water in the wash liquor are varied apparently in such a way that not all of the wax is solubilized, it can act as a suds depressant in the wash liquor also.

ANIONIC DETERGENTS

Preferably the detergent component of the present invention is a water-soluble salt of: an ethoxylated sulfated alcohol with an average degree of ethoxylation of about 1 to 4 and an alkyl chain length of about 14 to 16; tallow ethoxy sulfate; tallow alcohol sulfates; an alkyl benzene sulfonate with an average alkyl chain length between 11 and 12, preferably 11.2 carbon atoms; a $C_6$–$C_{20}\alpha$-sulfocarboxylic acid or ester thereof having 1 to 14 carbon atoms in the alcohol radical; a $C_8$–$C_{24}$ paraffin sulfonate; a $C_{10}$–$C_{24}$ $\alpha$-olefin sulfonate or mixtures thereof; or other anionic sulfur-containing surfactant. Such preferred detergents are discussed below.

An especially preferred alkyl ether sulfate detergent component of the present invention is a mixture of alkyl ether sulfates, said mixture having an average (arithmetic mean) carbon chain length within the range of about 12 to 16 carbon atoms, preferably from about 14 to 15 carbon atoms, and an average (arithemetic mean) degree of ethoxylation of from about 1 to 4 moles of ethylene oxide, preferably from about 2 to 3 mole of ethylene oxide.

Specifically, such preferred mixtures comprise from about 0 to 10% by weight of mixture of $C_{12-13}$ compounds, from about 50 to 100% by weight of mixture of $C_{14-15}$ compounds, and from about 0 to 45% by weight of mixture of $C_{16-17}$ compounds, and from about 0 to 10% by weight of a mixture of $C_{18-19}$ compounds. Further, such preferred alkyl ether sulfate mixtures comprise from about 0 to 30% by weight of mixture of compounds having a degree of ethoxylation of 0, from about 45 to 95% by weight of mixture of compounds having a degree of ethoxylation from 1 to 4, from about 5 to 25% by weight of mixture of compounds having a degree of ethoxylation from 5 to 8, and from about 0 to 15% by weight of mixture of compounds having a degree of ethoxylation greater than 8. The sulfated condensation products of ethoxylated alcohols of 8 to 24 alkyl carbons and with from 1 to 30, preferably 1 to 4 moles of ethylene oxide may be used in place of the preferred alkyl ether sulfates discussed above.

Another class of detergents which may be used in the present invention includes the water-soluble salts, particularly the alkali metal, ammonium, and alkylolammonium salts of organic sulfuric reaction products having in their molecular structure an alkyl group containing from about 8 to about 22 carbon atoms and a sulfuric acid ester group, Examples of this group of synthetic detergents are the sodium and potassium alkyl sulfates, especially those obtained by sulfating the higher alcohols ($C_8$–$C_{18}$ carbon atoms) produced by reducing the glycerides of tallow or coconut oil.

Preferred water-soluble organic detergent compounds herein include linear alkyl benzene sulfonates containing from about 9 to 15 carbon atoms in the alkyl group. Examples of the above are sodium and potassium alkyl benzene sulfonates in which the alkyl group contains from about 11 to about 12 carbon atoms, in straight chain or branched chain configuration, e.g. those of the type described in U.S. Pat. Nos. 2,220,099 and 2,477,383. Especially valuable are straight chain alkyl benzene sulfonates in which the average of the alkyl groups is about 11.2 carbon atoms, abbreviated as $C_{11.2}$LAS.

Another useful detergent compound herein includes the water-soluble salts of esters of $\alpha$-sulfonated fatty acids containing from about 6 to 20 carbon atoms in the fatty acid group and their esters from about 1 to 14 carbon atoms in the alcohol radical.

Preferred "olefin sulfonate" detergent mixtures utilizable herein comprise olefin sulfonates containing from about 10 to about 24 carbon atoms. Such materials can be produced by sulfonation of $\alpha$-olefins by means of uncomplexed sulfur trioxide followed by neutralization under conditions such that any sultones present are hydrolyzed to the corresponding hydroxy-alkane sulfonates. The $\alpha$-olefin starting materials preferably have from 14 to 16 carbon atoms. Said preferred $\alpha$-olefin sulfonates are described in U.S. Pat. No. 3,332,880, incorporated herein by reference.

The paraffin sulfonates embraced in the present invention are essentially linear and contain from 8 to 24 carbon atoms, preferably 12 to 20 and more preferably 14 to 18 carbon atoms in the alkyl radical.

Other anionic detergent compounds herein include the sodium alkyl glyceryl ether sulfates, especially those ethers of higher alcohols dervied from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups containing about 8 to about 12 carbon atoms.

Water-soluble salts of the higher fatty acids, i.e. "soaps", are useful as the detergent component of the composition herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e. sodium or potassium tallow and coconut soap.

It is preferred that soaps be absent, but up to about 3% by weight of the composition can be tolerated.

NONIONIC DETERGENTS

Suitable nonionic surfactants can be any of the alkoxylated surfactants known in the art. In general terms, the nonionics herein are water-soluble detersive surfactants (detergents) of the formula $$, R - O - (C_yH_{2y}O)_a - (C_zH_{2z})_b - C_wH_{2w}OH$$

wherein R is selected from the group consisting of primary, secondary, and branched chain alkyl hydrocarbyl moieties; primary, secondary, and branched chain alkenyl hydrocarbyl moieties; and primary, secondary, and branched chain alkyland alkenyl-substituted phenolic hydrocarbyl moieties; said hydrocarbyl moieties having a hydrocarbyl chain length of from 8 to about 20, preferably 10 to 16, carbon atoms. In the general formula for the alkoxylated nonionic surfactants herein, $y$ and $z$ are each integers of from 2 to about 3, preferably 2, either $x$ or $y$ being 2 when the other integer is 3 (i.e., excluding the all propylene-oxide (PO) surfactants); $w$ is an integer of from 2 to about 3, preferably 2; and $a$ and $b$ are each integers of from 0 to about 8, the sum of $a + b$ being in the range of from 6 to about 25, preferably 6 to 10. The formula of the surfactants herein encompasses ethylene oxide (EO) as well as mixed ethylene oxide-propylene oxide (EO-PO) alkoxylates, all of which are useful herein. The all-PO surfactants do not provide cleaning advantage in detergent compositions and are not contemplated for use herein.

Preferred nonionic surfactants used herein are the ethoxylated nonionics, both from the standpoint of availability and cleaning performance.

Specific examples of nonionic surfactants useful herein are as follows:

STRAIGHT-CHAIN, PRIMARY ALCOHOL ALKOXYLATES

The hexa-, hepta-, octa-, nona-, deca-, undeca-, dodeca-, tetradeca-, and hexadeca-alkoxyklates of n-octanol, n-decanol, n-dodecanol, n-tetradecanol, n-hexadecanol, and n-octadecanol having an HLB within the range recited herein are useful surfactants in the context of this invention; the respective ethylene oxide condensates are the most preferred alkoxylates. Exemplary aloxylated primary alcohols useful herein as the surfactant component of the mixtures are: n-$C_{10}$EO(6); n-$C_{10}$EO(9); n-$C_{12}$EO(9); n-$C_{14}$EO(10); n-$C_{10}$EO(10); n-$C_9$EO(9); n-$C_{16}$EO(14); and n-$C_{10}$EO(6)PO(3). The ethoxylates of mixed natural or synthetic alcohols in the "coconut" chain length range are also useful herein. Specific examples of such materials include coconut alkyl EO(6) and coconut alkyl EO(9).

STRAIGHT-CHAIN, SECONDARY ALCOHOL ALKOXYLATES

The hexa-, hepta-, octa-, nona-, deca-, undeca-, dodeca-, tetradeca-, and hexadeca-alkoxylates of 2-decanol, 2-tetradecanol, 3-hexadecanol, 2-octadecanol, 4-eicosanol, and 5-eicosanol having an HLB within the range recited herein are useful surfactants in the context of this invention; the respective ethylene oxide condensates are the most preferred alkoxylates. Exemplary alkoxylated secondary alcohols ueful herein as the surfactant component of the mixtures are: 2-$C_{10}$EO(9); 2-$C_{12}$EO(9); 2-$C_{14}$EO(10); 2-$C_{16}$EO(11); 4-$C_{20}$EO(11); 2-$C_{16}$EO(14); and 2-$C_{10}$EO6)PO(3). The most preferred straight chain, secondary alcohol alkoxylates herein are the materials marketed under the trade name Tergitol 15-S-9 and Tergitol 15-S-7, which comprise a mixture of secondary alcohols having an average hydrocarbyl chain length of 13 carbon atoms condensed with an average of 9 and 7 moles of ethylene oxide per mole equivalent of alcohol, respectively.

ALKYL PHENOLIC ALKOXYLATES

As in the case of the alcohol alkoxylates, the hexa- through hexadeca-alkoxylates of alkylated phenols, particularly monohydric alkyl phenols, having an HLB within the range recited herein are useful as the surfactant component of the instant mixtures. The respective ethylene oxide condensates are the most preferred alkoxylates. The hexa-through hexadeca-alkoxylates of p-hexaphenol, m-octylphenol, p-ocylphenol, p-nonylphenol, and the like are usual herein; most preferred are the ethoxylates of p-ocylphenol and p-nonylphenol inasmuch as these materials are readily available. Exemplary alkoxylated alkyl phenol useful as the surfactant component of the mixtures herein are: p-octylphenol EO(9), p-nonylphenol EO(9); p-decylphenol EO(9); o-dodecylphenol EO(10); and p-octylphenol EO(9-)PO(2). The most preferred alkyl phenol alkoxylates herein are p-octylphenol (nonoxyethylene) and p-nonylphenol (nonoxy-ethylene).

OLEFINIC ALKOXYLATES

The alkenyl alcohols, both primary and secondary, and alkenyl phenols corresponding to those disclosed immediately hereinabove can be alkoxylated to an HLB within the range recited herein and used as the surfactant component of the instant mixtures. Typical alkenyl alkoxylates herein are 2-n-dodecenol EO(9); 3-n-tetradecenol EO(9); p-(2-noneyl) phenol EO(9)PO(2); and 2-tetradecen-4-OL EO(9).

BRANCHED CHAIN ALKOXYLATES

Branched chain primary and secondary alcohols which are available by the well known "OXO" process can be alkoxylated and employed as the surfactant component of mixture herein. Exemplary branched-chain alkoxylates are as follows: 2-methyl-1-dodecanol EO(9); 3-ethyl-2-tetradecanol EO(9); 2-methyl-1-hexadecanol EO(9)PO(2), and the like.

The foregoing alkoxylated nonionic surfactants are useful in the present compositions and processes singly or in combination, and the term "nonionic surfactant" encompasses mixed nonionic surfactant systems containing multiple alkoxylated nonionic surface-active agents.

One mixed alkoxylated nonionic system which is particularly useful herein comprises a mixture of one or more of the foregoing detersive alkoxylated nonionic surfactants having an HLB in the range of from 11 to 17 (preferably 12 to 15) and, as a co-surfactant, one or more water-soluble alkoxylates having an HLB in the range of 7 to 11 (preferably 9 to 11). The two types of alkoxylated materials are combined in appropriate weight ratios to provide an overall HLB of the mixture of from about 9 to about 13 (preferably 10 to 12; most preferably 10.5 to 12.0). Such mixtures of nonionic surfactant and nonionic co-surfactant provide superior fabric cleaning performance and are particularly useful for removing greasy soil from polyester and cotton/-polyester fabric blends. These preferred nonionic surfactant-plus-nonionic co-surfactant alkoxylate mixtures are more fully described in the application of Collins, Ser. No. 406,413, filed Oct. 15, 1973, herein incorporated by reference.

Specific examples of alkoxylates which can be employed as co-surfactants to prepare nonionic mixtures useful in the present invention are as follows:

STRAIGHT CHAIN, PRIMARY ALCOHOL ALKOXYLATES

The di-, tri-, tetra-, and penta-alkoxylates of n-octanol, n-nonanol, n-decanol, and n-undecanol having an HLB of from 5 to 11 are useful co-surfactants in the context of this invention; the respective ethylene oxide condensates are the most preferred alkoxylates. Exemplary alkoxylated primary alcohols useful herein as the co-surfactant component of the mixtures are: n-$C_8$EO(2); n-$C_8$EO(3); n-$C_9$EO(3); n-$C_{10}$EO(3); n-$C_{11}$EO(3); n-$C_{10}$EO(4); n-$C_{10}$EO(3)PO(1); and n-$C_{10}$EO(2)PO(2). The most preferred straight chain, primary alcohol alkoxylate co-surfactant herein is n-$C_{10}$EO(3).

STRAIGHT CHAIN, SECONDARY ALCOHOL ALKOXYLATES

The di-, tri-, tetra-, and penta-alkoxylates of 2-nonanol, 3-decanol, 2-decanol, 3-tetradecanol, and 5-pentadecanol having an HLB within the range recited herein are useful co-surfactants in the context of this invention; the respective ethylene oxide condensates are the most preferred alkoxylates. Exemplary alkoxylated secondary alcohols useful herein as the co-surfactant component of the mixtures are: 2-$C_{10}$EO(3); 2-$C_{12}$EO(5); 2-$C_9$EO(2); 2-$C_{10}$EO(2)PO(2); and 2-$C_{12}$EO(3)PO(1). The most preferred straight chain, secondary alcohol alkoxylate herein is the material marketed under the trade name Tergitol 15-S-5, which comprises a mixture of secondary alcohols having an average hydrocarbyl chain length of 13 carbon atoms condensed with an average of 5 moles of ethylene oxide per mole equivalent of alcohol.

ALKYL PHENOLIC ALKOXYLATES

As in the case of the alcohol alkoxylates, the di - through penta-alkoxylates of alkylated phenols, particularly monohydric alkyl phenols, having HLB's within the range recited herein are useful as the co-surfactant component of the mixtures herein. The respective ethylene oxide condensates are the more preferred alkoxylates. The mono- through penta-alkoxylates of p-hexylphenol, m-octylphenol, p-octylphenol, and the like are useful herein; most preferred are the alkoxylates of p-octylphenol inasmuch as this material is readily available. Exemplary alkoxylated alkyl phenols useful as the cosurfactant component of the mixtures herein include: p-octylphenol EO(3); p-hexylphenol EO(3); p-octylphenol EO(5); p-octylphenol EO(4); and p-octylphenol EO(5)PO(2). The most preferred alkyl phenol alkoxylate co-surfactants herein are p-octylphenol EO(5).

OLEFINIC ALKOXYLATES

The alkenyl alcohols, both primary and secondary, and alkenyl phenols corresponding to those disclosed immediately hereinabove can be alkoxylated to an HLB within the range recited herein and used as the co-surfactant component of the instant mixtures. Typical alkenyl alkoxylates useful herein are 2-n-decenol EO(3); 2-pentadecen-4-ol EO(5); and p-(2-octenyl)phenol EO(3).

BRANCHED CHAIN ALKOXYLATES

Branched chain primary and secondary alcohols which are available by the well-known "OXO" process can be alkoxylated to an HLB within the co-surfactant range disclosed herein and employed in the instant mixtures. Exemplary branched chain alkoxylated co-surfactants are as follows: 2-methyl-1-dodecanol EO(3); 3-ethyl-2-decanol EO(3); 2-methyl-1-decanol EO(3-)PO(1); and the like. The ethylene oxide condensates of branched chain alcohols are preferred herein.

Also to be included with the nonionics are the amine oxide surfactants, viz:

A detergent having the formula $$R^1R^2R^3N \rightarrow O$$

(amine oxide detergent) wherein $R^1$ is an alkyl group containing from 10 to 28 carbon atoms, from 0 to about 2 hydroxy groups, and from 0 to about 5 ether linkages, there being at least one moiety of $R^1$ which is an alkyl group containing from 10 to 18 carbon atoms and no ether linkage; and $R^2$ and $R^3$ are selected from alkyl radicals and hydroxyalkyl radicals containing from 1 to about 3 carbon atoms.

Specific examples of amine oxide detergents include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis-(2-hydroxyethyl)-3-dodecoxy-1-hydroxypropylamine oxide, (2-hydroxypropyl)methyltetradecylamine oxide, dimethyloleyamine oxide, dimethyl-(2-hydroxydodecyl)amine oxide, and the corresponding decyl, hexadecyl, and octadecyl homologues of the above compounds. The corresponding phosphine oxides and sulphoxides are also suitable.

Suitable zwitterionic detergents are those described in U.S. Pat. No. 3,852,211 to Ohren, herein incorporated by reference. The compounds disclosed in Ohren include the following:

Zwitterionic synthetic detergents which are derivatives of aliphatic quaternary ammonium, phosphonium, and sulfonium compounds, in which the aliphatic groups can be straight chain or branched and wherein one of the aliphatic substituents contains from about 8 to 18 carbon atoms ane one contains an anionic water solubilizing group, e.g., carboxy, sulfonate, sulfate, phosphate, or phosphonate. A general formula for these compounds is:

$$R_1-Y^{+}(R_2)_x-CH_2-R_3-Z^{-}$$

wherein $R_1$ is an alkyl, alkenyl, hydroxyalkyl, or alkylbenzyl group containing from about 8 to about 24 carbon atoms and having from 0 to about 10 ethylene oxide moieties and from 0 to 1 glyceryl moiety; Y is selected from the group consisting of nitrogen, phosphorus, and sulfur atoms; $R_2$ is an alkyl or monohydroxy alkyl group containing 1 to about 3 carbon atoms; $x$ is 1 when Y is a sulfur atom and 2 when Y is a nitrogen or phosphorus atom; $R_3$ is an alkylene or hydroxy alkylene group of from 1 to about 4 carbon atoms; and Z is a member selected from the group consisting of carboxylate, sulfonate, sulfate, phosphonate, and phosphate groups.

Examples include:

4-[N,N-di(2-hydroxyethyl)-N-octadecyl-ammonio]-butane-1-carboxylate;
5-[S-3-hydroxypropyl-S-hexadecylsulfonio]-3-hydroxypentane-1-sulfate;
3-[P,[-diethyl-P-3,6,9-trioxatetracosanephosphonio]-2-hydroxypane-1-phosphate;
3-[N,N-dipropyl-N-3-dodecoxy-2-hydroxypropylammonio]-propane-1-phosphonate;
3-(N,N-dimethyl-N-hexadecylammonio)propane-1-sulfonate;
3-(N,N-dimethyl-N-hexadecyl-ammonio)-2-hydroxypropane-1-sulfonate;
4-[N,N-di(2-hydroxyethyl-N-(2-hydroxydodecyl)ammonio]-butane-1-carboxylate;
3-[S-ethyl-S-(3-dodecoxy-2-hydroxypropyl)sulfonio]-propane-1-phosphate;
3-[P,P-dimethyl-P-dodecylphosphonio]-propane-1-phosphonate;
S-[N,N-di(3-hydroxypropyl)-N-hexadecyl-ammonio]-2-hydroxypentane-1-sulfate
3-(dodecylbenzyldimethylammonio)propane-1-sulfonate; and
2-(dodecylbenzyldimethylammonio)ethane-1-sulfate.

Examples of compounds falling within this definition also include 3-(N,N-dimethyl-N-hexadecyl-ammonio)-propane-1-sulfonate and 3-(N,N-dimethyl-N-hexadecyl-ammonio)-2-hydroxypropane-1-sulfonate which are especially preferred herein for their availability and curd dispersant characteristics. Some of the compounds of this type as well as their use as dispersing agents are more fully described in U.S. Pat. Nos. 2,699,991 and 3,660,470 herein incorporated by reference.

Organic surface-active suds stabilizing agents, particularly the fatty acyl amides and alkylolamides may be present in the compositions. For the purposes of this specification, these are not included as part of the organic surfactant component of the compositions.

Particularly preferred compositions according to the invention are those based upon nonionic surfactants or mixed nonionic/zwitterionic surfactants and substantially free from anionic surfactants.

MICROCRYSTALLINE WAXES

The waxes suitable for the present invention have microcrystalline structure when solid and are preferably relatively high melting point waxes. They are substantially water-insoluble but are able to be dispersed in aqueous micellar solutions of organic surfactants and/or in neat liquid organic surfactants, e.g., as colloidal or micellar solutions or as true solutions or emulsions. They have a melting point in the range specified above, and preferably their melting points are in the range from about 65° C to about 100° C. Generally they have a molecular weight in the range from about 400 to 1000. Preferably they should not be too hard and brittle; that is to say, they should have a penetration value of at least 6 measured at 77° F by ASTM-D1321. Preferably the waxes have a high proportion of hydrocarbon chains in their constitution; that is, they have a saponification value less than 100, more preferably less than 60. Suitable waxes include petroleum-derived microcrystalline petrolatum waxes, oxidized microcrystalline petrolatum waxes, and petrolatum itself (petroleum jelly); synthetic waxes such as Fischer-Tropsch waxes and oxidized Fischer-Tropsch waxes; earth and peat waxes such as ozokerite, ceresin, and montan wax; natural waxes such as beeswax, candelilla, and carnauba wax.

Japan wax, waxes such as polyglycol distearate and polyethylene glycols (Carbowax — trade name) have been found to be unsuitable. Paraffin wax, which is macrocrystalline, has only a slight effect of the same sort as the microcrystalline waxes and is not within the scope of the present invention. The term "microcrystalline wax" or "petrolatum wax" is well known in the art and covers a somewhat variable class of substances. They are described in "The Chemistry and Technology of Waxes", A. H. Warth, 2nd edition, reprinted in 1960, Reinhold Publishing Corporation, pages 391–393 and 421 and on. As the name implies, the individual crystals of microcrystalline wax are much smaller than those of praffin wax. In general, microcrystalline waxes are tough rather than brittle; some of them are flexible even at low temperatures. Although microcrystalline wax is largely paraffinic in its chemical nature, the compounds of which it consists are not the same as those which constitute paraffin wax. The compounds which constitute microcrystalline wax have a materially higher molecular weight and higher proportion of branched chain hydrocarbons than do those found in paraffin waxes. Microcrystalline wax is derived from oils heavier than those from which paraffin waxes are made and usually is recovered from residual oils, that is, from oils taken off as distillation bottoms. Ester waxes suitable in the invention comprise $C_{16}$–$C_{60}$ alcohols radicals condensed with $C_{16}$–$C_{20}$ fatty acids. The ester waxes are preferably saturated and essentially linear in character. Petrolatum or petroleum jelly also has microcrystalline structure, as have the natural waxes, beeswax, carnauba, and azokerite, (ibid, pages 391–393). Fischer-Tropsch waxes are obtained by the process known by this name and are also microcrystalline in nature.

Particularly preferred are microcrystalline petrolatum waxes known as "Be Square 175", sold by the Bareco Division, Petrolite Corporation, Tulsa, Oklahoma, and Mobilwax 2305 sold by the Mobil Oil Company Limited, Wallasey Bridge Road, Birkenhead, Cheshire, England.

Some very effective waxes are microcrystalline waxes such as:

- Microcrystalline wax 160/165 sold by Shell Chemicals;
- Microcrystalline wax 185/190 sold by Shell Chemicals;
- Microcrystalline wax 160/25Y sold by BP Chemicals;
- Microcrystalline wax OK239 sold by Astor Chemicals Ltd.;
- Mobilwax Cerese sold by Mobil Oil Company Limited;
- Mobilwax 2360 sold by Mobil Oil Company Limited; and Fischer-Tropsch waxes, such as those sold by Veba Chemic A. G. are also suitable.

DETERGENT BUILDERS

Suitable detergency builder salts include the polyphosphate builders such as alkali metal pyro- and tripolyphosphates; other inorganic builders include alkali metal carbonates, silicates, and borates. Preferred alkali metal builders are the sodium and potassium salts.

Organic builders include sodium NTA, carboxylated starches, amino polyacetates, citrates, mellitates, and EHDP.

Preferably the compositions of the invention contain from about 10% to 25% of organic surfactant. The content of builder is preferably from about 10% to 90%, preferably 20% to about 50% by weight. Quite low levels of wax are sufficient, for instance, usually from about 0.1% to 3%, especially from about 0.4% to 1.5%.

The compositions may contain any of the other components usual in laundry detergent compositions. These include bleaching agents such as inorganic perhydrates, e.g., sodium perborate, soil suspending agents such as sodium carboxymethylcellulose, other inorganic salts such as sodium sulfate, chloride, silicates, other suds controlling agents, enzymes, antioxidants, activators or stabilizers for bleaching agents or enzymes, tarnish inhibitors, optical brighteners, germicides, textile softening agents, coloring and perfuming substances.

COMPOSITION PREPARATION

In preparing the compositions it is important that the wax be intimately associated with the detergent, and it appears to be possible to achieve this only be mixing the wax with the liquid or pasty surfactant at some stage during the preparation of the product in such conditions that the mixture is liquid. This may be done in various ways. In general, it is preferred to mix the molten was and the organic detergent before they are added to the principle other components of the composition. Thus the wax may be dissolved in a liquid nonionic or in a liquid aqueous dispersion or "paste" comprising a zwitterionic or anionic detergent. Usually the latter would be the "paste" form in which these detergents are conveniently prepared or manufactured, for instance, containing some 10% to 50%, more usually 20% to 40% by weight of the surfactant itself. The liquid mixtures of wax and detergent are added to the slurry of other ingredients (crutcher mix) for spray drying, or they may be sprayed on or otherwise blended with one or more granular or powdery components of the final composition, for instance, the spray-dried components or or another suitable carrier material. Of course, compatible minor components such as perfumes, enzymes, antioxidants, etc. may be included in the wax detergent mixtures if desired. Alternatively, as a less preferred procedure for making the granular products, the wax or the surfactant may be included in the crutcher mix and the other component, viz. surfactant or wax, added in thereafter. Given adequate mixing time and suitable temperature, this method also achieves sufficiently intimate mixing and effective products result when the crutcher mix is spray dried.

EXAMPLES

The following compositions were prepared:

| Composition No. | 1 | 2 | 3 | 4 | 5 | 6 |
|---|---|---|---|---|---|---|
| Tergitol 15-S-9 | 6 | — | — | — | 9 | — |
| $C_{14.8}$ HAPS | 6 | 6 | — | — | — | — |
| Dobanol 45-E-7 | — | 6 | 12 | — | — | — |
| $C_{10}AE_3$ | — | — | — | — | 11 | — |
| $CNAE_6$ | — | — | — | 12 | — | — |
| LAS | — | — | — | — | — | 14 |
| Sodium toluene sulfonate | — | — | — | — | — | 1.5 |
| Soap | — | — | — | 2 | — | — |
| Coconut monoethanolamide | — | — | — | 4 | — | 1 |
| Sodium tripoly- | | | | | | |

-continued

| Composition No. | 1 | 2 | 3 | 4 | 5 | 6 |
|---|---|---|---|---|---|---|
| phosphate | 36 | 28 | 36 | 36 | 36 | 37 |
| Sodium silicate | 7 | 7 | 7 | 7 | 7 | 6 |
| Sodium sulfate | 5 | 13 | 5 | 5 | 4 | 5 |
| Sodium perborate tetrahydrate | 25 | 25 | 25 | 25 | 24 | 20 |
| Sodium CMC | 0.5 | 0.5 | 0.5 | 1 | 0.5 | 1 |
| Mobilwax 2305 | 0.5 | 0.5 | 0.5 | 0.5 | 0.5 | 0.5 |
| Moisture and minor components | 14 | 14 | 14 | 7.5 | 8 | 14 |

In these compositions Tergitol 15-S-9 is a trade name and is understood to represent a condensate of 9 moles of ethylene oxide per mole of mixed linear secondary alcohols having 11 to 15 carbon atoms; Dobanol 45-E-7 is a trade name and is understood to refer to a condensate of 7 moles of ethylene oxide per mole of mixed linear primary alcohols having 14 to 15 carbon atoms. $C_{14.8}$ HAPS is alkyl (14.8C) dimethyl ammonio hydroxypropane sulfonate; $C_{10}AE_3$ and $CNAE_6$ refer to condensates of 3 and 6 moles of ethylene oxide with $C_{10}$ and conconut alcohols; LAS refers to sodium linear dodecyl benzene sulfonate; the soap was 80/20 tallow/coconut sodium soap; sodium CMC is sodium carboxymethyl cellulose; Mobilwax 2305 is the trade name for a microcrystalline wax marketed by Mobil Oil Company Limited and having a melting point of 170° F to 175° F.

In each case a comparative sample was prepared with the wax omitted, termed composition la etc. in the table of results. The compositions, with wax, were prepared as follows:

1, 2, 4, and 5 — The molten wax was dissolved in the liquid nonionic or nonionic mixture which had been heated to above the melting point of the wax. Spray-dried granules were prepared comprising the remaining components, except perborate and perfume. The nonionic/wax mixture was sprayed onto the spray-dried granules, which were perfumed and then dry blended with the perborate.

3 — The molten wax was dissolved in the Dobanol, as above, and the mixture was added to the crutcher mix comprising the other components of the composition, except perborate and perfume. This was then spray dried, and the perborate and perfume mixed with the spray-dried granules.

6 — The wax was melted and added to the hot LAS paste in the crutcher. After these had been mixed together, the other ingredients were added, except perborate and perfume, and spray dried. The perfume and perborate were added to the spray dried granules.

The sudsing behavior of these compositions was compared as follows:

EQUIPMENT AND CONDITIONS

Bowls — 4 perspex bowls 12 inch diameter
Two hand towels approximately 4 oz. each
Water — soft
Clock — seconds divisions
Temperature — wash 115° F, rinse, cold
Product concentration — Current hand-wash concentrations, — Or as specified.

PROCEDURE

Add 1 gallon of soft water at 115° F to the first (wash) bowl and 1 gallon of cold soft water to each of the other 3 (rinse) bowls. Place the towels in the first bowl.

Add the product to the wash bowl and agitate for 30 secs. Allow to settle for 2 minutes. Measure the suds height attained in inches.

Lift and squeeze each towel in turn for a period of 60 secs. Each towel should receive 16 squeezes. Remove towels and by gently squeezing the towels down their length, remove most of the liquor. Finally fold each towel into four and, with a wringing action, remove as much liquor as possible. Measure suds height in inches.

Carry the towels to the first rinse bowl and lift and squeeze each towel four times in 15 seconds. The liquor is removed as before.

Measure the suds height and visually assess the percentage coverage of suds on the water.

Suds height × % coverage = Rinsing Index

Repeat rinsing procedure for second and third rinses.

Suds measured were as follows:

| Composition | Wash Suds Height Inches | Rinse 1 | Rinse 2 | Rinse 3 |
|---|---|---|---|---|
| | | Rinsing Index | | |
| 1a | 2.4 | 60 | 60 | 20 |
| 1 | 2.0 | 40 | 18 | 8 |
| 2a | 1.0 | 60 | 20 | 10 |
| 2 | 0.8 | 20 | 8 | 5 |
| 3a | 1.5 | 60 | 30 | 20 |
| 3 | 0.4 | 8 | 3 | ½ |
| 4a | 1.5 | 60 | 40 | 20 |
| 4 | 1.3 | 40 | 16 | trace |
| 5a | 1.4 | 70 | 50 | 40 |
| 5 | 1.4 | 40 | 20 | 7 |
| 6a | 3.0 | 60 | 50 | 20 |
| 6 | 3.0 | 50 | 40 | 10 |

Compositions 1, 2, 4 and 5 demonstrate little or no loss of suds in the wash and greatly reduced suds in the rinse; composition 3 demonstrates a case of reduced sudsing also in the wash. Composition 6 demonstrates the somewhat less marked but still valuable effect of the wax addition in an anionic based composition.

What is claimed is:

1. A granular built detergent composition which comprises:

a. from about 2% to about 40% by weight of an organic synthetic detergent selected from the group consisting of nonionic, zwitterionic, and anionic detergents and mixtures thereof;

b. from about 0.02% to about 5% by weight of a substantially water-insoluble microcrystalline wax having a melting point in the range from 35° C to 115° C and saponification value less than 100 or mixtures thereof; and c. from about 10% to about 90% by weight of detergency building salt or mixtures thereof; said wax in intimate admixture with the said organic detergent.

2. A composition according to claim 1 wherein the organic detergent is a polyethoxy nonionic detergent or a mixture thereof and a zwitterionic detergent.

3. A composition according to claim 1 wherein the organic detergent is present at from about 10% to about 25% by weight.

4. A composition according to claim 3 wherein the microcrystalline wax has a melting point in the range from 65° C to 100° c.

5. A composition according to claim 4 wherein the microcrystalline wax has a molecular weight in the range from 400 to 1000.

6. A composition according to claim 5 wherein the wax is selected from the group consisting of petroleum-derived microcrystalline waxes, oxidized microcrystalline waxes, Fischer-Tropsch waxes, oxidized Fischer-Tropsch waxes, montan waxes, earth waxes, beeswax, carnauba wax and candelilla wax.

7. A composition according to claim 6 which contains from 0.4 to 1.5% by weight of said wax.

8. A granular detergent composition according to claim 7 which contains from 20% to 50% by weight of builder salts.

9. A composition according to claim 8 wherein the builder salts are selected from alkali metal carbonates, bicarbonates, borates, phosphates, polyphosphates, silicates, water-soluble amino polyacetates, and polyphosphonates.

10. A composition according to claim 9 wherein the builder is selected from sodium tripolyphosphate, sodium nitrilotriacetate, sodium mellitate, sodium citrate, and sodium carbonate.

11. A composition according to claim 3, wherein the water-soluble microcrystalline wax is petrolatum.

* * * * *

UNITED STATES PATENT OFFICE
CERTIFICATE OF CORRECTION

PATENT NO. : 4,056,481

DATED : November 1, 1977

INVENTOR(S) : John Robert Tate

It is certified that error appears in the above-identified patent and that said Letters Patent are hereby corrected as shown below:

Column 7, lines 56-60, the formula should be $$R_1 - \overset{(R_2)_x}{\overset{|}{Y^+}} - CH_2 - R_3 - Z^-$$

Claim 1, column 12, lines 54-56, "building salt or mixtures thereof;" is part of c. and should be at line 54 after "gency"; and "said wax in intimate admixture with the said organic detergent." should be out to the margin and not indented as if part of c.

Claim 11, column 14, line 11, "water-soluble" should be --water-insoluble--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*